US008661707B2

(12) United States Patent
Dittmer et al.

(10) Patent No.: US 8,661,707 B2
(45) Date of Patent: Mar. 4, 2014

(54) LAUNDRY DRIER

(75) Inventors: Lothar Dittmer, Berlin (DE); Thomas Nawrot, Berlin (DE); Andreas Ziemann, Potsdam (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 2276 days.

(21) Appl. No.: 10/557,363

(22) PCT Filed: May 13, 2004

(86) PCT No.: PCT/EP2004/005149

§ 371 (c)(1),
(2), (4) Date: Nov. 14, 2006

(87) PCT Pub. No.: WO2004/104289

PCT Pub. Date: Dec. 2, 2004

(65) Prior Publication Data

US 2007/0163144 A1 Jul. 19, 2007

(30) Foreign Application Priority Data

May 23, 2003 (DE) ..... 103 23 494

(51) Int. Cl.
*F26B 25/00* (2006.01)

(52) U.S. Cl.
USPC ..... 34/606; 68/23 R; 8/137

(58) Field of Classification Search
USPC ..... 34/595, 602, 606, 610; 68/5 R, 23 R; 8/137, 149, 159
See application file for complete search history.

(56) References Cited

U.S. PATENT DOCUMENTS

| | | | | | |
|---|---|---|---|---|---|
| 1,872,401 | A | * | 8/1932 | Butzbach | 34/131 |
| 2,372,790 | A | * | 4/1945 | Morgenstern | 34/609 |
| 2,434,886 | A | * | 1/1948 | Pugh | 34/60 |
| 2,486,058 | A | * | 10/1949 | Patterson et al. | 34/82 |
| 2,526,030 | A | * | 10/1950 | Kagan | 38/2 |
| 2,540,725 | A | * | 2/1951 | Geldhof | 34/82 |
| 2,547,238 | A | * | 4/1951 | Tremblay | 34/603 |
| 2,589,284 | A | * | 3/1952 | O'Neil | 34/77 |
| 2,608,769 | A | * | 9/1952 | O'Neil | 34/131 |
| 2,617,203 | A | * | 11/1952 | Murray | 34/82 |
| 2,635,354 | A | * | 4/1953 | Geldhof et al. | 34/131 |
| 2,648,142 | A | * | 8/1953 | Shapter | 34/82 |
| 2,675,628 | A | * | 4/1954 | O'Neil | 34/75 |
| 2,707,837 | A | * | 5/1955 | Paulsen et al. | 34/607 |
| 2,722,750 | A | * | 11/1955 | Smith et al. | 34/82 |
| 2,722,751 | A | * | 11/1955 | Steward | 34/82 |

(Continued)

FOREIGN PATENT DOCUMENTS

| | | | | |
|---|---|---|---|---|
| DE | 3219977 A1 | * | 12/1983 | D06F 58/22 |
| DE | 3446356 C1 | * | 3/1986 | D06F 58/22 |

(Continued)

*Primary Examiner* — Steve M Gravini
(74) *Attorney, Agent, or Firm* — James E. Howard; Andre Pallapies

(57) ABSTRACT

A program-controlled laundry drier equipped with a rotary drum in which the material to be dried is inserted and moved during the drying process. The dryer comprising a heater for heating the drying air and a blower which guides the drying air stream into the interior of the drum. The axis of a current generator is mechanically coupled to the rotary drum and the output voltage of the current generator is applied to the excitation winding of a relay whose switching contacts switch the heating current circuit for the drying air.

31 Claims, 2 Drawing Sheets

(56) References Cited

U.S. PATENT DOCUMENTS

| | | | | | |
|---|---|---|---|---|---|
| 2,734,281 | A * | 2/1956 | Kauffman, II | 34/87 |
| 2,795,055 | A * | 6/1957 | Huebsch | 34/82 |
| 2,798,304 | A * | 7/1957 | Reiter | 34/91 |
| 2,798,306 | A * | 7/1957 | Reiter | 34/609 |
| 2,827,276 | A * | 3/1958 | Racheter | 432/62 |
| 2,852,236 | A * | 9/1958 | Jackson | 366/185 |
| 2,925,663 | A * | 2/1960 | Smith | 34/75 |
| 2,958,138 | A * | 11/1960 | Ashby | 34/601 |
| 2,959,867 | A * | 11/1960 | Doty | 34/82 |
| 2,964,851 | A * | 12/1960 | Stelljes et al. | 34/82 |
| 3,022,580 | A * | 2/1962 | Doty | 34/60 |
| 3,042,471 | A * | 7/1962 | Haslup | 312/329 |
| 3,047,187 | A * | 7/1962 | Taylor et al. | 220/378 |
| 3,060,593 | A * | 10/1962 | Flora et al. | 34/601 |
| 3,069,785 | A * | 12/1962 | Mitter et al. | 34/562 |
| 3,084,531 | A * | 4/1963 | Matheny | 68/210 |
| 3,171,428 | A * | 3/1965 | Bozeman | 34/90 |
| 3,177,592 | A * | 4/1965 | Meyer | 34/82 |
| 3,197,886 | A * | 8/1965 | Brame et al. | 34/90 |
| 3,249,146 | A * | 5/1966 | Remick, Jr. et al. | 431/70 |
| 3,263,343 | A * | 8/1966 | Loos | 34/82 |
| 3,290,027 | A * | 12/1966 | Alumbaugh | 432/41 |
| 3,309,783 | A * | 3/1967 | Worst | 34/553 |
| 3,399,464 | A * | 9/1968 | Erickson et al. | 34/605 |
| 3,435,537 | A * | 4/1969 | Rumsey, Jr | 34/72 |
| 3,570,138 | A * | 3/1971 | Douglas | 34/601 |
| 3,579,851 | A * | 5/1971 | Elmy | 34/82 |
| 3,582,582 | A * | 6/1971 | Pauker et al. | 200/38 B |
| 3,601,903 | A * | 8/1971 | Freze | 34/609 |
| 3,610,422 | A * | 10/1971 | Jager | 211/1.3 |
| 3,722,106 | A * | 3/1973 | Takeyama et al. | 34/82 |
| 3,729,834 | A * | 5/1973 | Fox | 34/139 |
| 3,735,062 | A * | 5/1973 | Chestnut et al. | 200/38 R |
| 3,811,202 | A * | 5/1974 | Arendt | 34/599 |
| 3,969,070 | A * | 7/1976 | Thompson | 432/105 |
| 4,007,546 | A * | 2/1977 | Sauer | 34/602 |
| 4,053,992 | A * | 10/1977 | Furgal | 34/60 |
| 4,096,602 | A * | 6/1978 | Nelson | 16/85 |
| 4,132,009 | A * | 1/1979 | Bochan | 34/534 |
| 4,305,211 | A * | 12/1981 | Peterson | 34/92 |
| 4,314,409 | A * | 2/1982 | Cartier et al. | 34/82 |
| 4,381,430 | A * | 4/1983 | Smock et al. | 200/35 R |
| 4,700,495 | A * | 10/1987 | Drews et al. | 34/603 |
| 4,702,018 | A * | 10/1987 | Hastings | 34/130 |
| 4,720,925 | A | 1/1988 | Griffith et al. | |
| 4,765,066 | A * | 8/1988 | Yoon | 34/261 |
| 4,817,298 | A * | 4/1989 | Toma | 34/595 |
| 4,899,264 | A * | 2/1990 | Ries et al. | 362/92 |
| 4,934,559 | A * | 6/1990 | Putnam | 220/377 |
| 4,964,228 | A * | 10/1990 | Coffman | 34/242 |
| 5,094,015 | A * | 3/1992 | Griffith | 34/235 |
| 5,107,606 | A * | 4/1992 | Tsubaki et al. | 34/596 |
| 5,113,562 | A * | 5/1992 | Studt | 29/401.1 |
| 5,136,792 | A * | 8/1992 | Janecke | 34/78 |
| 5,195,647 | A * | 3/1993 | Studt | 220/810 |
| 5,207,764 | A * | 5/1993 | Akabane et al. | 68/20 |
| 5,253,433 | A * | 10/1993 | Frey | 34/603 |
| 5,257,468 | A * | 11/1993 | Lebrun | 34/235 |
| 5,279,047 | A * | 1/1994 | Janecke | 34/78 |
| 5,365,675 | A * | 11/1994 | Shabram, Jr. | 34/109 |
| 5,548,904 | A * | 8/1996 | Rood | 34/82 |
| 5,555,647 | A * | 9/1996 | Torborg et al. | 34/601 |
| D380,884 | S * | 7/1997 | Gormly | D32/25 |
| 5,664,340 | A * | 9/1997 | Brown | 34/275 |
| 5,713,139 | A * | 2/1998 | Briggs | 34/602 |
| 5,819,437 | A * | 10/1998 | Briggs | 34/604 |
| 5,881,579 | A * | 3/1999 | Ellingson | 68/24 |
| 5,974,693 | A * | 11/1999 | Richards et al. | 34/600 |
| 6,062,049 | A * | 5/2000 | Martinsson | 68/140 |
| 6,115,936 | A * | 9/2000 | Arlie | 34/61 |
| 6,154,978 | A * | 12/2000 | Slutsky | 34/321 |
| 6,212,792 | B1 * | 4/2001 | Bier | 34/315 |
| 6,381,874 | B1 * | 5/2002 | Floyd | 34/602 |
| 6,671,978 | B1 * | 1/2004 | McGowan et al. | 34/596 |
| 6,678,969 | B1 * | 1/2004 | Hong | 34/595 |
| 6,757,986 | B2 * | 7/2004 | Miller et al. | 34/132 |
| 6,910,286 | B2 * | 6/2005 | Hwang | 34/601 |
| 6,922,913 | B2 * | 8/2005 | Hood et al. | 34/595 |
| 6,928,745 | B2 * | 8/2005 | Lickiss et al. | 34/104 |
| 6,931,761 | B2 * | 8/2005 | Hwang | 34/601 |
| 6,935,048 | B2 * | 8/2005 | Park et al. | 34/132 |
| 6,941,679 | B1 * | 9/2005 | Harris et al. | 34/596 |
| 6,968,632 | B2 * | 11/2005 | Guinibert et al. | 34/602 |
| 7,024,795 | B2 * | 4/2006 | Tadano et al. | 34/76 |
| 7,065,905 | B2 * | 6/2006 | Guinibert et al. | 34/603 |
| 7,204,039 | B2 * | 4/2007 | Cho et al. | 34/596 |
| 7,225,562 | B2 * | 6/2007 | Guinibert et al. | 34/601 |
| 7,228,646 | B1 * | 6/2007 | Purcell | 34/90 |
| 7,257,905 | B2 * | 8/2007 | Guinibert et al. | 34/82 |
| 7,320,186 | B2 * | 1/2008 | Schone | 34/603 |
| 7,380,423 | B1 * | 6/2008 | Musone | 68/20 |
| 7,418,789 | B2 * | 9/2008 | Choi et al. | 34/380 |
| 7,434,334 | B2 * | 10/2008 | Hwang et al. | 34/606 |
| 7,467,483 | B2 * | 12/2008 | Guinibert et al. | 34/601 |
| 7,523,564 | B2 * | 4/2009 | Doh | 34/601 |
| 7,543,396 | B2 * | 6/2009 | Nishino et al. | 34/606 |
| 7,559,156 | B2 * | 7/2009 | Renzo | 34/595 |
| 7,614,162 | B2 * | 11/2009 | Renzo | 34/603 |
| 7,644,515 | B2 * | 1/2010 | Doh | 34/603 |
| 7,698,910 | B2 * | 4/2010 | Kim et al. | 68/12.01 |
| 2001/0010125 | A1 * | 8/2001 | Bier | 34/322 |
| 2004/0010936 | A1 * | 1/2004 | Han | 34/595 |
| 2004/0089031 | A1 * | 5/2004 | Kim et al. | 68/196 |
| 2004/0134093 | A1 * | 7/2004 | Han | 34/595 |
| 2004/0159009 | A1 * | 8/2004 | Hwang | 34/601 |
| 2004/0159010 | A1 * | 8/2004 | Hwang | 34/601 |
| 2004/0200093 | A1 * | 10/2004 | Wunderlin et al. | 34/606 |
| 2005/0016016 | A1 * | 1/2005 | Lickiss et al. | 34/601 |
| 2005/0044744 | A1 * | 3/2005 | Tadano et al. | 34/596 |
| 2005/0050762 | A1 * | 3/2005 | Hood et al. | 34/595 |
| 2005/0076535 | A1 * | 4/2005 | Guinibert et al. | 34/601 |
| 2005/0115104 | A1 * | 6/2005 | Guinibert et al. | 34/601 |
| 2005/0120586 | A1 * | 6/2005 | Hwang et al. | 34/603 |
| 2005/0155250 | A1 * | 7/2005 | Chung et al. | 34/602 |
| 2005/0183284 | A1 * | 8/2005 | Hwang et al. | 34/603 |
| 2006/0101666 | A1 * | 5/2006 | Cho et al. | 34/596 |
| 2006/0156767 | A1 * | 7/2006 | Kim et al. | 68/175 |
| 2006/0213073 | A1 * | 9/2006 | Emma | 34/60 |
| 2006/0260150 | A1 * | 11/2006 | Doh | 34/601 |
| 2006/0265899 | A1 * | 11/2006 | Renzo | 34/603 |
| 2006/0265959 | A1 * | 11/2006 | Renzo | 49/381 |
| 2007/0006477 | A1 * | 1/2007 | Guinibert et al. | 34/85 |
| 2007/0051012 | A1 * | 3/2007 | Schoene | 34/603 |
| 2007/0173423 | A1 * | 7/2007 | Vermeer et al. | 510/101 |
| 2007/0186440 | A1 * | 8/2007 | Guinibert et al. | 34/603 |
| 2007/0220776 | A1 * | 9/2007 | Guinibert et al. | 34/603 |
| 2007/0256317 | A1 * | 11/2007 | Johnson | 34/82 |
| 2008/0060218 | A1 * | 3/2008 | Doh | 34/601 |
| 2008/0098773 | A1 * | 5/2008 | Beeks | 68/235 R |
| 2008/0104862 | A1 * | 5/2008 | Dittmar et al. | 34/601 |
| 2008/0163510 | A1 * | 7/2008 | Dittmar et al. | 34/108 |
| 2008/0271336 | A1 * | 11/2008 | Doh | 34/82 |
| 2009/0064534 | A1 * | 3/2009 | LeClerc | 34/603 |
| 2009/0083987 | A1 * | 4/2009 | Prajescu | 34/130 |
| 2009/0126417 | A1 * | 5/2009 | Ripley et al. | 68/196 |
| 2009/0158616 | A1 * | 6/2009 | Ricklefs et al. | 34/601 |
| 2009/0165331 | A1 * | 7/2009 | Kim | 34/493 |
| 2009/0165391 | A1 * | 7/2009 | Kocak et al. | 49/480.1 |
| 2010/0077633 | A1 * | 4/2010 | Bae et al. | 34/90 |
| 2010/0088917 | A1 * | 4/2010 | Lim | 34/88 |

FOREIGN PATENT DOCUMENTS

| | | | | |
|---|---|---|---|---|
| DE | 4304086 | C1 * | 3/1994 | D06F 58/20 |
| DE | 19708777 | A1 * | 9/1998 | D06F 58/22 |
| JP | 53112552 | A * | 10/1978 | F26B 11/04 |
| JP | 53112553 | A * | 10/1978 | F26B 11/04 |
| JP | 09294898 | A * | 11/1997 | D06F 58/28 |
| JP | 10286399 | A * | 10/1998 | D06F 58/02 |
| JP | 2000225298 | A * | 8/2000 | D06F 58/04 |

* cited by examiner

LAUNDRY DRIER

The invention relates to a laundry drier with a rotating drum.

U.S. Pat. No. 4,720,925 discloses a laundry drier comprising a horizontally arranged rotating drum, an inlet opening for process air on the rearward face of the drum and an outlet for process air which is arranged in the lower section of the bearing plate underneath a charging opening for clothing. The outlet opening is arranged in a sloping section of the bearing plate and is covered with a grid.

A disadvantage with this arrangement is that items of clothing can come to rest on the outlet grid since an underpressure prevails in the area of the outlet grid. This occurs particularly when the drum has a minimum load, and as the degree of drying of the laundry increases and when drying easy-care laundry since the laundry which is then lighter is entrained further and only detaches from the drum and drops down at a late stage. The fall curve can be so wide that the laundry only drops down in the other half of the drum and is pulled over the grid of the outlet opening by the rotational movement of the drum which results in short-term hindrance of air passage through the grid. This non-steady flow hindrance or pulsation of the flow produces noises and results in longer drying times because of the reduced air throughput.

It is the object of the invention to provide a drier which ensure a flow of process air through the drum which is as unperturbed as possible.

This object is solved by a drier having the features of claim 1.

Since the laundry drier has a projection before the outlet opening in the principal direction of rotation, the laundry which falls in front of the outlet opening in the direction of rotation and is entrained by the movement of the drum is guided away from the outlet opening so that the outlet opening is not covered by items of laundry. The projection thus serves to deflect the laundry from the outlet opening. In this case, the projection is preferably arranged so that the laundry is returned into the interior of the drum. The arrangement thus ensures an improved flow of process air through the drum which means a shortening of the drying time. Furthermore, this arrangement significantly reduces the development of noise, especially with minimum loading since the laundry is kept away from the outlet opening. In addition, hazardous situations such as overheating are avoided.

The arrangement is especially advantageous if the outlet opening is arranged on an annular housing section which is located between a laundry charging opening which can be closed by a door and the front open face of the drum. It is especially advantageous if the outlet opening covered by a grid is arranged on a lower section of the annular housing section which is constructed as descending towards the drum.

Since the projection is constructed as a wedge-shaped body which has a guiding wall which rises progressively from the annular housing section before the outlet opening in the principal direction of rotation and extends as far as the outlet opening and which has a front wall which descends steeply from the guiding wall towards the outlet opening, laundry which falls on the annular housing section before the outlet opening in the direction of rotation is conveyed back into the interior of the drum by the rotational movement and prevented from at least partly closing the outlet opening. It is especially advantageous if the projection is made to emerge from the annular housing section at the height of half the diameter of the drum and is made to rise in a sickle shape as far as the outlet opening and descend steeply in front of the outlet opening.

Since the front wall of the projection has an opening which is connected to an outlet channel arranged downstream of the outlet opening, process air can additionally flow unhindered via this opening, which measurably improves the overall air throughput.

It is furthermore advantageous if the annular housing section is constructed as a bearing plate between the charging opening and the drum, on which elements for mounting the front end of the drum are provided.

It is furthermore possible to rotate the drum in a direction of rotation opposite to the principal direction of rotation if a tangle of laundry can be released thereby for example or the heating time can be shortened. In the case of a laundry drier which has a so-called reversing drum, it can thus be advantageous if one projection is arranged symmetrically to the outlet opening on both sides of the outlet opening. The advantageous effect of deflecting the laundry is thus achieved in each direction of rotation.

Since the inside of the door has an additional projection which projects adjacent to the outlet opening further into the interior of the drum than on a section of the door remote from the outlet opening, this additional projection acts as a laundry deflector which keeps the falling laundry away from the outlet opening and conveys it back into the drum. This mode of action is intensified if the additional projection seen in the principal direction of rotation projects further into the interior of the drum at the end of the additional projection than at the beginning of the additional projection.

Further features and advantages of the invention are obtained from the following description of an exemplary embodiment with reference to the appended drawings.

Figure 1:
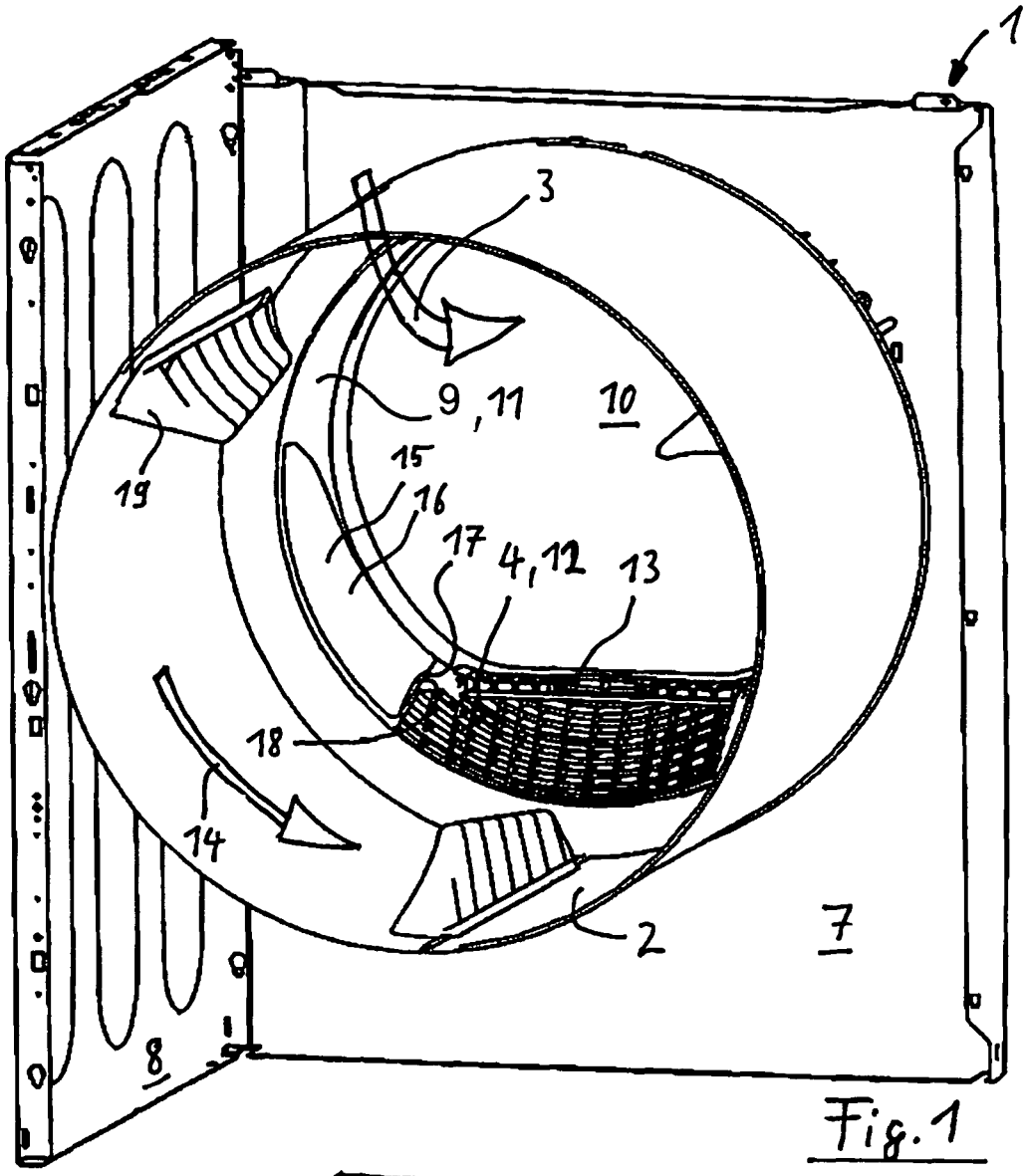
FIG. 1 is a cutaway oblique view of a laundry drier from the inside of the drum towards the charging opening.

According to FIG. 1, a drier has a housing 1, a substantially horizontally arranged drum, an inlet opening 3 for warm process air in the drum and an outlet opening for process air from the drum, a charging opening 5 for laundry on the front of the drum 2 and a door 6 (FIG. 3) for closing the charging opening 5.

The inlet opening 3 is arranged in a middle section of the rear face of the drum 2 (the rear face of the drum 2 is cut away in FIG. 1 and thus cannot be seen). The housing 1 has a front plate 7 on which the door 6 is fixed, two side plates 8 (only one is shown) and an annular body 9 which is arranged between the charging opening 5 and the front open face 10. Since the front end of the drum 2 is mounted on the annular body 9, the annular body 9 is also designated as bearing plate 11. Located on a lower section of the annular body 9 or the bearing plate 11 is the outlet opening 4 for process air which is covered by a grid 12. Located underneath the grid is an outlet channel (not shown) which is connected to the suction side of a fan (not shown). Provided adjacent to the grid 12 on the bearing plate 11 is a lint filter 13 which can be inserted into the outlet channel. The lower section of the bearing plate 11 on which the outlet opening 4 is arranged is constructed as sloping steeply from the charging opening 5 towards the front of the drum. The drum 2 which can be arranged so that it slopes downwards from the horizontal at the back with a preferred angle of inclination of 1°-35° has a principal direction of rotation 14 (arrow).

Figure 2:
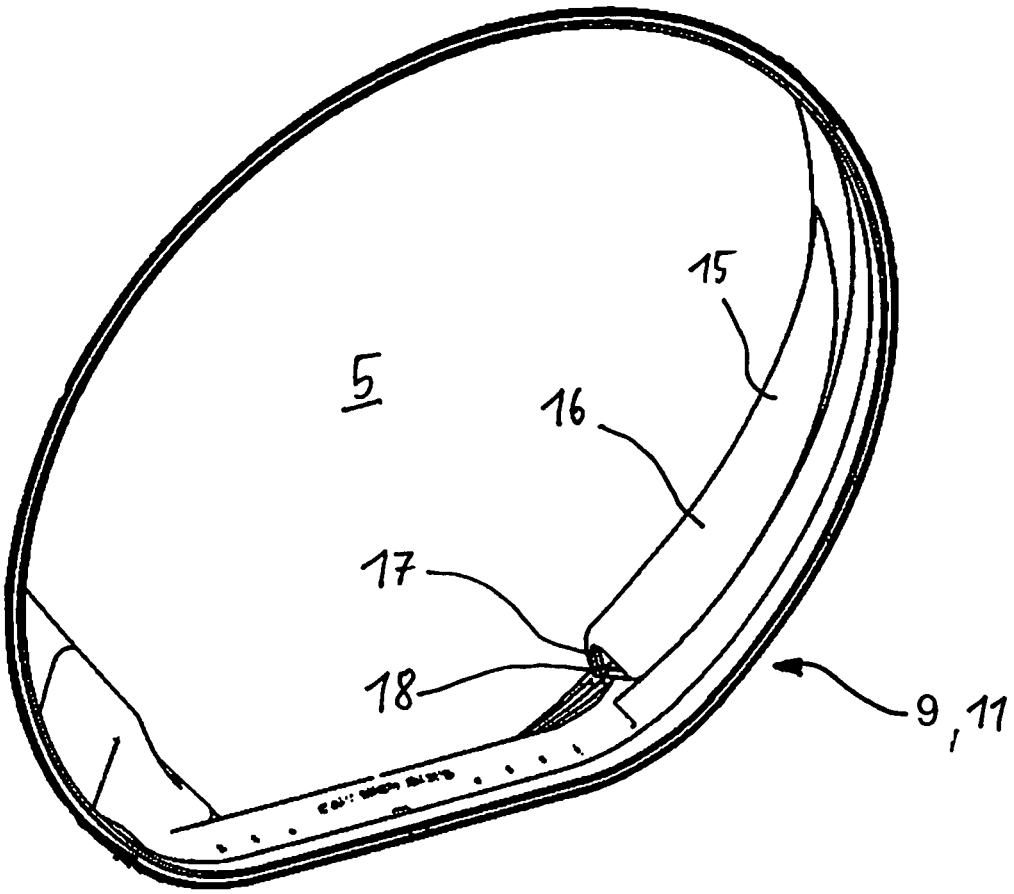
FIG. 2 is an oblique view of the bearing plate used in FIG. 1 viewed from the outside into the charging opening.

A projection 15 is arranged on the bearing plate 11 constructed as annular body 9 before the outlet opening 4 in the principal direction of rotation 14. The projection 15 is constructed as a wedge-shaped body having a guiding wall 16 and a front wall 17. The guiding wall 16 rises from the bearing plate beginning approximately at half the height of the drum and rises increasingly towards the edge of the outlet opening 4 and at this point descends steeply towards the annular body 9, approximately at right angles to the surface of the annular body 9. In other words, the projection 15 emerges from the annular body 9 at the height of half the diameter of the drum and rises increasingly in a sickle shape towards the outlet opening 4 (FIG. 1 and FIG. 2). Located on the front wall 17 of the projection 15 is an opening 18 which is connected to the outlet channel (not shown). When the drum rotates in the principal direction of rotation 14, the laundry is entrained by the entraining device 19 and depending on the rotational speed and also on the degree of moisture of the laundry (weight of the laundry), seen in the principal direction of rotation 14, detaches from the outer surface of the drum 2 approximately in an area of +/−70° and drops downwards. Laundry which falls onto the section of the bearing plate 11 arranged in the principal direction of rotation 14 before the outlet opening or the grid 12 is guided towards the inside of the drum 2 on the one hand and guided over the grid 12 on the other hand. In this way the projection 15 acts as a laundry deflector which deflects the laundry away from the grid 12 into the drum. This effectively reduces the suction or resting of the laundry onto the grid 12 at which an underpressure prevails. The laundry is especially always kept at a distance from the grid 12 by the front wall 17 of the projection 15 which reduces the frequency of sucked-on laundry. If the laundry is sucked onto the grid 12, the duration of suction of laundry onto the grid 12 is shortened by the projection 15. This avoids perturbations in the conveyance of process air through the drying compartment constructed as the drum 2 which results in an increased air throughput through the drying compartment and therefore shorter drying times. In addition, noise caused by suction of laundry onto the outlet opening 4 or the grid 12 is effectively reduced. It is especially advantageous if process air can additionally flow via the opening 18 arranged in the front wall 17 since this opening lies in the "shade" of the projection 15 and thus is almost never covered by laundry.

Figure 3:
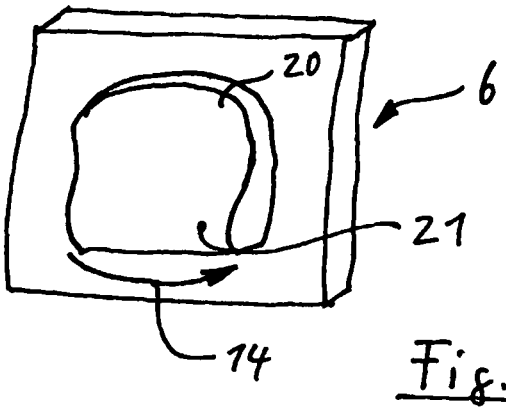
FIG. 3 is an oblique view of the inside of a door for closing the charging opening of a laundry drier from FIG. 1.

FIG. 3 shows an inner view of the door 6 which has a body 20 projecting into the charging opening 5. This body 20 has an additional projection 21 which, when the door 6 is closed, projects adjacent to the outlet opening 4 further into the interior of the drum 2 than at a section emote from the outlet opening 4. It is especially advantageous if the additional projection 21 seen in the principal direction of rotation 14, projects further into the interior of the drum 2 at the end of the additional projection 21 than at the beginning of the additional projection 21. This additional projection 21 serves as a laundry deflector similar to the projection 15 so that the laundry falling from the top of the drum 2 is guided into the interior of the drum and does not fall on the grid 12 and become sucked thereon.

The preceding embodiment is primarily designed for operation of the laundry drier in the principal direction of rotation 14. However, driers are also available which operate in the so-called reversing mode to reduce the heating time for example or to improve the distribution of the laundry inside the drum. In a laundry drier operating in the reversing mode, a projection 15 can be arranged symmetrically to the outlet opening 4 on both sides of the outlet opening 14.

The invention claimed is:

1. A laundry drier comprising:

a housing;

a drum rotating about an axis in a principal rotational direction within the housing and forming a drying chamber for laundry, the drum having an front open face;

a charging opening, the charging opening being formed on the housing and axially spaced from the front open face of the drum, the charging opening providing access to the drum for placing laundry into, and removing laundry from, the drum;

an inlet opening for process air in the drum;

an outlet opening for process air from the drum, the outlet opening being located on the housing axially intermediate the charging opening and the front open face of the drum; and a projection mounted to the housing axially intermediate the charging opening and the front open face of the drum at a position upstream of the outlet opening relative to the principal direction of drum rotation and projecting outwardly from the housing for deflecting laundry approaching the outlet opening away from the outlet opening, the projection being positioned such that laundry that is within a space bounded on one axial side by the front open face of the drum and on an opposite axial side by the charging opening is engaged by the projection as such laundry approaches the outlet opening.

2. The laundry drier according to claim 1, wherein the housing has an annular housing section between the charging opening and the drum on which the outlet opening is arranged, which opening is in turn covered by a grid.

3. The laundry drier according to claim 2, wherein the annular housing section has a lower section which decreases from the charging opening towards the drum on which the outlet opening is constructed.

4. The laundry drier according to claim 2, wherein the projection is constructed as a wedge-shaped body which has a guiding wall which rises progressively from the annular housing section before the outlet opening in the principal direction of rotation and extends as far as the outlet opening and which has a front wall which descends steeply from the guiding wall towards the outlet opening.

5. The laundry drier according to claim 2, wherein the projection emerges from the annular housing section at the height of half the diameter of the drum and rises in a sickle shape as far as the outlet opening increasingly towards the annular housing section.

6. The laundry drier according to claim 1, wherein the projection has an opening adjacent to the outlet opening which is connected to an outlet channel arranged downstream of the outlet opening.

7. The laundry drier according to claim 2, wherein the annular housing section is constructed as a bearing plate between the charging opening and the drum, on which elements for mounting the front end of the drum are provided.

8. The laundry drier according to claim 2, wherein the projection includes two projections arranged symmetrically to the outlet opening on both sides of the outlet opening.

9. The laundry drier according to claim 1, wherein the inside of the door adjacent to the outlet opening has an additional projection which projects into the interior of the drum adjacent to the outlet opening.

10. The laundry drier according to claim 9, wherein the additional projection seen in the principal direction of rotation projects further into the interior of the drum at the end of the additional projection than at the beginning of the additional projection.

11. A laundry drier comprising:

a housing;

a drum supported by the housing for rotation with respect to the housing in a principal rotational direction and forming a drying chamber;

a charging opening, the charging opening being formed on the housing and providing access to the drum for placing laundry into, and removing laundry from, the drum;

an opening in fluid flow communication with the drying chamber, the opening communicating the drying chamber with an outlet such that process air can flow from the drying chamber to the outlet during a laundry drying operation in which the charging opening is closed off and the drum is rotating; and a projection extending radially inwardly from the housing and disposed adjacent the opening for deflecting the laundry away from the opening.

12. The laundry drier according to claim 11, wherein the housing includes an annular housing section fixed with respect to the housing and surrounding a charging opening providing access to the drum, the projection being connected to the annular housing section and extending radially inwardly from the annular housing section.

13. The laundry drier according to claim 12, wherein the projection is integrally formed with the annular housing section.

14. The laundry drier according to claim 12, wherein the projection includes a guiding wall steadily extending from the annular housing section to a maximum distance from the annular housing section adjacent the opening.

15. The laundry drier according to claim 14, wherein the projection includes a front wall at an end of the projection nearest the opening, the front wall defining a projection opening being a secondary outlet opening receiving air flow from the drum and being in fluid flow communication with an outlet channel discharging air flow from the laundry drier.

16. The laundry drier according to claim 14, further comprising a door connected to the housing and being movable between an open condition, in which the door permits access to the drum, and a closed condition, in which the door restricts access to the drum, the door having an additional projection extending inwardly toward the drum and at least partially extending over the opening when the door is in the closed condition.

17. The laundry drier according to claim 14, further comprising a second projection extending radially inwardly from the housing and disposed adjacent the opening for deflecting the laundry away from the opening, the projection and the second projection being disposed on opposite sides of the opening.

18. The laundry drier according to claim 11, further comprising an inlet opening providing air flow to the drum, the opening being an outlet opening receiving air flow from the drum.

19. The laundry drier according to claim 11, further comprising a grid covering the opening.

20. The laundry drier according to claim 19, further comprising a lint filter disposed adjacent the grid.

21. The laundry drier according to claim 11, wherein the projection is disposed before the opening in the principal rotational direction.

22. A laundry drier comprising:

a housing;

a drum supported by the housing for rotation about an axis with respect to the housing in a principal rotational direction and forming a drying chamber and the drum having an open front face;

an annular housing section fixed with respect to the housing and surrounding a charging opening providing access to the drum, the annular housing section being fixed with respect to the housing axially intermediate the charging opening and the front open face of the drum;

an inlet opening providing air flow to the drum;

an outlet opening receiving air flow from the drum, the outlet opening being located on the housing axially intermediate the charging opening and the front open face of the drum; and a projection connected to the annular housing section axially intermediate the charging opening and the front open face of the drum and extending radially inwardly from the annular housing section adjacent the outlet opening and before the outlet opening in the principal rotational direction for deflecting laundry away from the opening, the projection being positioned such that laundry that is within a space bounded on one axial side by the front open face of the drum and on an opposite axial side by the charging opening is engaged by the projection as such laundry approaches the outlet opening.

23. The laundry drier according to claim 22, wherein the projection includes a wedge-shaped body having a guiding wall rising progressively from the annular housing section before the outlet opening in the principal direction of rotation and extending as far as the outlet opening and having a front wall descending steeply from the guiding wall towards the outlet opening, the front wall defining a projection opening being a secondary outlet opening receiving air flow from the drum, the outlet opening and the secondary outlet opening being in fluid flow communication with an outlet channel discharging air flow from the laundry drier.

24. The laundry drier according to claim 22, further comprising a door connected to the housing and being movable between an open condition, in which the door permits access to the drum, and a closed condition, in which the door restricts access to the drum, the door having an additional projection extending inwardly toward the drum and at least partially extending over the opening when the door is in the closed condition.

25. The laundry drier according to claim 22, wherein the outlet opening is covered by a grid.

26. The laundry drier according to claim 25, wherein the annular housing section has a lower section which decreases from the charging opening towards the drum on which the outlet opening is constructed.

27. The laundry drier according to claim 25, wherein the projection is constructed as a wedge-shaped body which has a guiding wall which rises progressively from the annular housing section before the outlet opening in the principal direction of rotation and extends as far as the outlet opening and which has a front wall which descends steeply from the guiding wall towards the outlet opening.

28. The laundry drier according to claim 25, wherein the projection emerges from the annular housing section at the height of half the diameter of the drum and rises in a sickle shape as far as the outlet opening increasingly towards the annular housing section.

29. The laundry drier according to claim 22, wherein the projection has an opening adjacent to the outlet opening which is connected to an outlet channel arranged downstream of the outlet opening.

30. The laundry drier according to claim 1, wherein the drum includes an entraining device that projects radially inwardly, the entraining device entrains laundry in the drum as the drum rotates such that entrained laundry is advanced in the principal direction of rotation of the drum, the entraining device of the drum moves past the projection during each rotation of the drum and, with respect to an item of laundry having one portion entrained by the entraining device and another portion that is within the space bounded on one axial side by the front open face of the drum and on an opposite axial side by the charging opening, the another portion of the item of laundry is engaged by the projection as this portion approaches the outlet opening during advancing movement of the item of laundry in the principal direction of rotation of the drum and the continued advancing movement of the item of laundry in the principal direction of rotation of the drum causes the another portion of the item of laundry engaged by the projection to be moved relatively along the projection.

31. The laundry drier according to claim 22, wherein the drum includes an entraining device that projects radially inwardly, the entraining device entrains laundry in the drum as the drum rotates such that entrained laundry is advanced in the principal direction of rotation of the drum, the entraining device of the drum moves past the projection during each rotation of the drum and, with respect to an item of laundry having one portion entrained by the entraining device and another portion that is within the space bounded on one axial side by the front open face of the drum and on an opposite axial side by the charging opening, the another portion of the item of laundry is engaged by the projection as this portion approaches the outlet opening during advancing movement of the item of laundry in the principal direction of rotation of the drum and the continued advancing movement of the item of laundry in the principal direction of rotation of the drum causes the another portion of the item of laundry engaged by the projection to be moved relatively along the projection.

* * * * *

UNITED STATES PATENT AND TRADEMARK OFFICE

CERTIFICATE OF CORRECTION

PATENT NO. : 8,661,707 B2
APPLICATION NO. : 10/557363
DATED : March 4, 2014
INVENTOR(S) : Dittmer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 2476 days.

Signed and Sealed this
Twenty-ninth Day of September, 2015

Michelle K. Lee

Michelle K. Lee
*Director of the United States Patent and Trademark Office*